US006834169B2

(12) United States Patent
Hren et al.

(10) Patent No.: US 6,834,169 B2
(45) Date of Patent: Dec. 21, 2004

(54) MULTI-BIN ORIENTATION SENSITIVE PRINTING SYSTEM AND METHOD

(75) Inventors: Allan Anthony Hren, Longmont, CO (US); Paul E. Roberts, Johnstown, CO (US); Kent S. Norgren, Louisville, CO (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/366,772

(22) Filed: Feb. 14, 2003

(65) Prior Publication Data

US 2004/0161258 A1 Aug. 19, 2004

(51) Int. Cl.[7] ..... G03G 15/00
(52) U.S. Cl. ..... 399/82; 399/81
(58) Field of Search ..... 399/45, 85, 82, 399/374, 401, 83, 391, 81

(56) References Cited

U.S. PATENT DOCUMENTS

| | | | | |
|---|---|---|---|---|
| 4,924,275 | A | 5/1990 | Nelson | |
| 6,029,020 | A | 2/2000 | Blackman et al. | 399/45 |
| 6,285,844 | B1 * | 9/2001 | Kuga | 399/85 |
| 2001/0007619 | A1 * | 7/2001 | Kakutani | |
| 2002/0113357 | A1 * | 8/2002 | Seto et al. | |
| 2002/0159091 | A1 * | 10/2002 | Sakura | |
| 2003/0053837 | A1 * | 3/2003 | Yergenson | |

FOREIGN PATENT DOCUMENTS

JP 06027774 A * 2/1994 ..... G03G/15/00

OTHER PUBLICATIONS

*Simplex/Duplex Mode Switching in a Electrophotographic Collation Printer, IBM Technical Disclosure Bulletin* Aug. 1989, pp. 274–281.

* cited by examiner

*Primary Examiner*—Susan Lee
(74) *Attorney, Agent, or Firm*—Kunzler & Associates

(57) ABSTRACT

An apparatus, system and method for printing a print job for which the pages are orientation sensitive and includes both simplex pages and duplex pages is provided. The apparatus, system, and method includes a controller that communicates with a print module. Program code within the controller is programmed to selectively designate based on control information associated with the print job a first bin for paper to print a simplex page and a second bin for paper to print a duplex page. The first bin may be associated with a single bin indicated by the print job and is used for simplex pages while the second bin is used for duplex pages of the print job. The first bin comprises paper oriented for simplex pages and the second bin comprises paper oriented for duplex pages. The paper in the first bin and second bin may be oriented with respect to side sensitivity and/or edge sensitivity. Simplex pages are threaded along the simplex path and duplex pages are threaded along the duplex path.

30 Claims, 7 Drawing Sheets

MULTI-BIN ORIENTATION SENSITIVE PRINTING SYSTEM AND METHOD

BACKGROUND OF THE INVENTION

1. The Field of the Invention

The invention relates to devices, methods, and systems for printing simplex and duplex pages of a print job. Specifically, the invention relates to devices, methods, and systems for printing orientation sensitive simplex and duplex pages within a single print job.

2. The Relevant Art

Information is becoming increasingly more available in digital format. The information is stored for example on hard disk drives, CD-ROMs, memory cards, etc. For text information, however, many people still prefer to store, disseminate, and review printed pages. To get the information from a digital format to printed pages, printers are used.

FIG. 1 illustrates a conventional printing system 100 used for printing documents. Generally, a host application 102 prepares and formats a print job 104. The host application 102 is typically a software application with printing capabilities. For example, the host application 102 may include a word processor, a spreadsheet, a scheduler, or the like. Alternatively, the host application 102 may be a print server, printer driver, operating system component, or other software component configured to provide a print job 104 to a printer 106.

Typically, the print job 104 comprises control information and data. The data is the information stored as a document that is to be reproduced on a printed page. While the term "document" as used herein generally refers to text documents, those of skill in the art recognize that a document may comprise a variety of types of printed information available from a printer including text, graphics, or a combination of these. The control information provides instructions to the printer regarding the format, type, and layout of the printed page on the paper.

The print job 104 may be sent to a printer 106 across a link 108. While a conventional printer 106 is illustrated and described, those of skill in the art will readily recognize that the printer 106 may be embodied as an ink jet printer, laser printer, copier, mopier, or other document reproducing office machine. The link 108 represents a communication path between the application 102 and the printer 106. The link 108 may be a direct connection such as a parallel port, but is most often a network connection such as a wired or wireless LAN (Local Area Network) connection. The printer 106 is configured to print the document on paper as requested by the print job 104.

Generally, the printer 106 prints on pre-cut sheets of paper of a selected size and orientation fed from a bin. The paper is fed in one direction through the printer 106 with the paper originating in a portrait or landscape orientation. The printer 106 prints either on the side facing up or the side facing down as a sheet passes through the printer 106.

The printer 106 may be configured in certain currently available systems to provide both simplex printing, and duplex printing. As used herein, simplex printing refers to printing on a single side of a sheet of paper and duplex printing refers to printing on both sides of a sheet of paper. Consequently, simplex pages are pages which have printed information on one side of a sheet of paper and duplex pages are pages which have printed information on both sides of a sheet of paper.

The conventional manner of simplex printing and duplex printing on conventional blank sheets is relatively straight forward. The paper is fed through the printing mechanism and out to a stacker. If the page is a simplex page, the paper passes straight through the printer. If the page is a duplex page, one page is printed on one side and then the paper is flipped over and the paper passes through the printing mechanism again to print a page on the opposite side of the paper. By flipping the paper, a single side print mechanism is capable of duplex printing.

Simplex printing and duplex printing becomes more complicated when the paper includes special characteristics. Examples of such characteristics include letterhead, preprinted single or dual sided forms, paper containing watermarks, logos, borders, or backgrounds on one side, paper with a special finish or design on one side, and the like. Paper for which a designated side is intended to receive printed information is referred to herein a side-sensitive paper. The page to be printed on is referred to as a side-sensitive page. Because conventional printers 106 are designed to only print on one side at a time, side-sensitive pages generally require that the paper face either up or down in the bin.

In addition, the paper may include physical characteristics such as holes along one edge, an irregular shaped edge, perforations, or the like, such that a designated placement of the information on the page in relation to the physical characteristic is desired. Paper for which the edge or other physical characteristics of the paper requires that a certain edge be oriented in a particular direction in relation to the printing mechanisms is referred to herein as edge-sensitive paper. Because conventional printers 106 are designed to minimize paper movement, including flipping, edge-sensitive paper must be oriented in the bin with a particular edge facing the printer 106.

Of course, pages may be printed on paper which is both side sensitive and edge sensitive. The term "orientation sensitive" as used herein refers to print jobs and corresponding paper which are side sensitive, edge sensitive, or both side and edge sensitive. Orientation sensitive print jobs require that the paper be placed in the bin in such a manner that a particular side is facing up and a particular edge is facing the printer 106. The particular paper characteristics discussed above may cause pages to be orientation sensitive for either simplex printing, duplex printing, or both.

FIG. 1A illustrates a problem which exists when printing simplex and duplex pages on orientation sensitive paper that passes through a printer 106 configured to print on a single side of the paper at a time. Suppose orientation sensitive paper 110 is supplied to a printer 106 that executes a print job 104 for printing simplex and duplex pages. The paper 110 in this example has holes punched on the left-hand side. Generally, simplex pages travel along a simplex path 112. Along the simplex path 112, the paper 110 is not flipped, consequently, the paper 110 exits the printer 106 in the same orientation, with the holes oriented on the left-hand side. Duplex pages travel along a duplex path 114 and are flipped to allow for printing on the opposite side. Because the duplex page is flipped, as mentioned above, the duplex page exits that printer 106 with the holes oriented on the right-hand side. Of course, this problem is compounded if the simplex pages require one type of orientation sensitive paper and the duplex pages require a different type of orientation sensitive paper. For example, in addition to being edge-sensitive, the duplex pages may be side-sensitive as well.

Generally, it is desirable to make the printing process as automated as possible. Currently, users expect the printed pages they retrieve from the printer to be properly oriented. Orientation sensitive pages which exit the printer in a non-uniform orientation require a user to re-arrange the pages. This may be inconvenient, particularly if the number of duplex pages and simplex pages varies considerably. In the worst case, a user may be required to rearrange every other page in the stack of printed pages for a document. Consequently, one problem faced in the relevant art is that printing information on orientation sensitive paper in which some pages are simplex and some are duplex results in pages stacked in a non-uniform orientation.

FIG. 1B illustrates a simplified side view of a printer 106. Of course, the printer 106 may include other components which are not illustrated herein for clarity purposes. Illustrated in FIG. 1B are examples of a simplex path 112 and a duplex path 114. Generally, the printer 106 is designed to minimize cost and the number of moving parts. Accordingly, the printer 106 includes a print module 116 that prints on one side of the paper as the paper travels through the print module 116. In printers that are capable of printing on both sides simultaneously, there is generally no need for both a simplex path 112 and a duplex path 114.

The simplex path 112 (indicated by solid arrows) begins with take-up rollers 118. The take-up rollers 118 feed a sheet of paper 110 from a bin 120 and thread the paper 110 into the print module 116. The print module 116 prints the page on one side of the paper, generally the underside. The printed simplex page is then placed in the stacker 122. The stacker 122 collects the printed pages as they are completed. When the print job 104 is finished, all the printed pages may be retrieved from the stacker 122.

The duplex path 114 (indicated by the dashed arrows) also begins with the take-up rollers 118. The paper 110 travels the same path as a simplex page into the print module 116. Once the paper 110 exits the print module 116, however, a flipper 124 directs the paper using a plurality of rollers 126 and guides the paper back into the print module 116 with the opposite side facing up from when the last page was printed. The direction of travel of the paper 110 is reversed. The print module 116 then prints the opposite side, and the printed duplex page is placed into the stacker 122.

Referring still to FIG. 1B, as indicated above, orientation sensitive paper that passes through the simplex path 112 and the duplex path 114 in a single print job 104 results in a non-uniform orientation in the stacker 122. Several solutions to this problem have been attempted. In one solution, if a print job 104 includes both simplex and duplex pages, all of the pages travel along the duplex path 114. In this manner, all the pages in the stacker 122 have a uniform orientation. However, the simplex pages are unnecessarily flipped and moved within the printer 106. This unnecessary movement causes excessive wear and tear on printer components and may lead to premature failure. Furthermore, making the simplex pages travel the duplex path 114 reduces the throughput for the print job 104. The throughput may be degraded as much as 50%, in situations where most of the pages are printed in simplex.

Referring to FIG. 1C, in another solution, one paper bin of the printer contains paper oriented for simplex pages and a second bin contains paper oriented for duplex pages. The host application 102 is programmed to identify which bin to use for each page or groups of pages. For example, the host application 102 may include an instruction 128*a* indicating that for Pages 1–3, Bin 2 is to be used. Pages 1–3 may be duplex pages. Similarly, instruction 128*b* may indicate that Pages 4–6 use Bin 1 which holds paper oriented for simplex pages. In this manner, the paper may be oriented properly in Bin 1 and Bin 2 such that when the printed pages are stacked in the stacker 122, the pages have a uniform orientation.

Unfortunately, this solution requires significant changes to a host application 102. The logic for determining which page is fed from which bin must be incorporated into each host application 102. Modifying, upgrading, and updating the potentially many thousands of host applications 102 which may interface with the printer 106 is impractical.

Accordingly, what is needed is an improved system and method that overcomes the problems and disadvantages of the prior art. In particular, the system and method should print a print job comprising orientation sensitive pages such that the printed pages are stacked in uniform orientation. In addition, the system and method should print a print job comprising orientation sensitive pages without requiring programming changes to a host application. Furthermore, the system and method should print a print job comprising orientation sensitive pages such that duplex pages travel along a duplex path and simplex pages travel along a simplex path. The system and method should allow for printing a print job comprising orientation sensitive pages such that the host application can designate a single bin. Additionally, the improved system and method for printing a print job comprising orientation sensitive pages should allow a user to designate a simplex bin, a duplex bin, and/or whether a print job is orientation sensitive.

SUMMARY OF THE INVENTION

The various elements of the present invention have been developed in response to the present state of the art, and in particular, in response to the problems and needs in the art that have not yet been fully solved by currently available printing systems. Accordingly, the present invention provides an improved apparatus, method, and system for printing a print job for which the pages are orientation sensitive.

In one aspect of the present invention, an apparatus for printing a print job for which the pages are orientation sensitive includes a controller that communicates with a print module. Program code resides within the controller, and is programmed to selectively designate a first bin for paper to print simplex pages of a print job based on control information associated with the print job. The program code is further programmed to selectively designate a second bin for paper to print duplex pages of a print job based on control information associated with the print job. Alternatively, the program code may designate other selected bins for printing duplex pages and further selected bins for printing simplex pages. Generally, one bin may be designated for print jobs involving simplex pages while a second bin may be designated for print jobs involving duplex pages.

The print module, in one embodiment, includes a simplex path and a duplex path. Simplex pages are threaded along the simplex path and duplex pages are threaded along the duplex path. Preferably, the first bin comprises paper oriented for simplex pages and the second bin comprises paper oriented for duplex pages. The paper in the first bin and/or second bin may be oriented with respect to side sensitivity and/or edge sensitivity.

In certain embodiments, the apparatus comprises a user interface that allows a user to select a first bin and a second bin. The user interface may include a display, an input module, and an output module. The input module may communicate with the display to prompt a user for a selection of a first bin for simplex pages, and a second bin for duplex pages. Alternatively, the simplex bin may by default be the single bin indicated by the print job and the user may only be prompted for a duplex bin which is logically linked to the simplex bin. In addition, the user interface may allow a user to identify that a pending print job is orientation sensitive.

The output module preferably communicates a user's selection to a controller that communicates with a print module to selectively designate between the first bin and the second bin for different pages of a print job based on control information associated with a print job. The display may comprise a touch sensitive LCD or monitor for providing graphic prompts and allowing a user to provide the selection. Alternatively, the user interface may include a keypad or other input device to allow a user to provide the selection.

In one embodiment, the controller, program code, user interface, and print module may be included within a printer, copier, or other printing system. The system may include a communication module for receiving a print job comprising simplex and duplex pages. Alternatively, the controller, program code, user interface, and print module may be implemented in separate components. For example, the user interface may be integrated with a host application while the controller, program code, and print module are integrated with a printer.

In another aspect of the present invention, a method for printing a print job for which pages are orientation sensitive is provided. The method includes designating a bin for simplex feeding of paper, and a bin for duplex feeding of paper for a printer. Alternatively, a printing system may associate the simplex bin with a single bin identified by the print job and a duplex bin may be designated by default. Next, a print job comprising a simplex page and a duplex page is received. Paper is fed from the simplex bin to print the simplex page and fed from the duplex bin to print the duplex page in response to control information for the print job.

The method may further include threading the simplex page along a simplex path and threading the duplex page along a duplex path through the printer. The pages are printed such that simplex pages and duplex pages are placed in a stacker with a uniform orientation. Alternatively, a user may designate the simplex bin and the duplex bin as well as designating a print job as orientation sensitive.

The various elements and aspects of the present invention provide a novel apparatus for printing a print job for which the pages are orientation sensitive. A print job comprising orientation sensitive simplex and duplex pages is printed such that the printed pages are stacked in a uniform orientation. Paper movement and code changes to the host applications are minimized. These and other features and advantages of the present invention will become more fully apparent from the following description and appended claims, or may be learned by the practice of the invention as set forth hereinafter.

BRIEF DESCRIPTION OF THE DRAWINGS

In order that the manner in which the advantages of the invention will be readily understood, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

It will be readily understood that the components of the present invention, as generally described and illustrated in the Figures herein, may be arranged and designed in a wide variety of different configurations. Thus, the following more detailed description of the embodiments of the system and method of the present invention, as represented in FIGS. 2 through 5, is not intended to limit the scope of the invention, as claimed, but is merely representative of selected embodiments of the invention.

The illustrated embodiments of the invention will be best understood by reference to the drawings, wherein like parts are designated by like numerals throughout. Those of ordinary skill in the art will, of course, appreciate that various modifications to the devices, systems and processes illustrated in FIGS. 2 through 5 may readily be made without departing from the essential characteristics of the invention. Thus, the following description is intended only by way of example, and simply illustrates certain selected embodiments of devices, systems and processes that are consistent with the invention as claimed herein.

Many of the functional units described in this specification have been labeled as modules, in order to more particularly emphasize their implementation independence. For example, modules may be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module. For example, a module of executable code could be a single instruction, or many instructions, and may even be distributed over several different code segments, among different programs, and across several memory devices.

Modules may also be implemented in hardware as electronic circuits comprising custom VLSI circuitry, off-the-shelf semiconductors such as logic chips, transistors, or other discrete components. A module may also be implemented in programmable hardware devices such as field programmable gate arrays, programmable array logic, programmable logic devices or the like.

Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Figure 1:
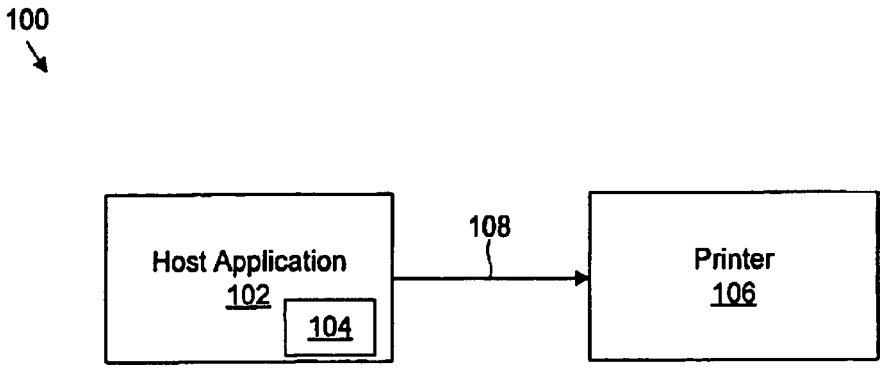
FIG. 1 is a block diagram illustrating a conventional printing environment.
Figure 1A:
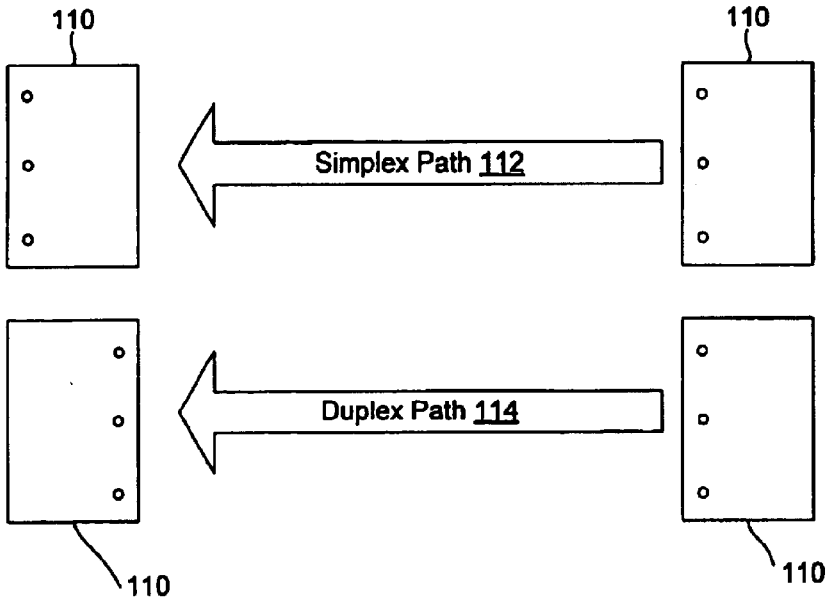
FIG. 1A (PRIOR ART)
FIG. 1A is a block diagram illustrating a conventional problem associated with printing orientation sensitive simplex pages and duplex pages on a conventional printer.
Figure 2:
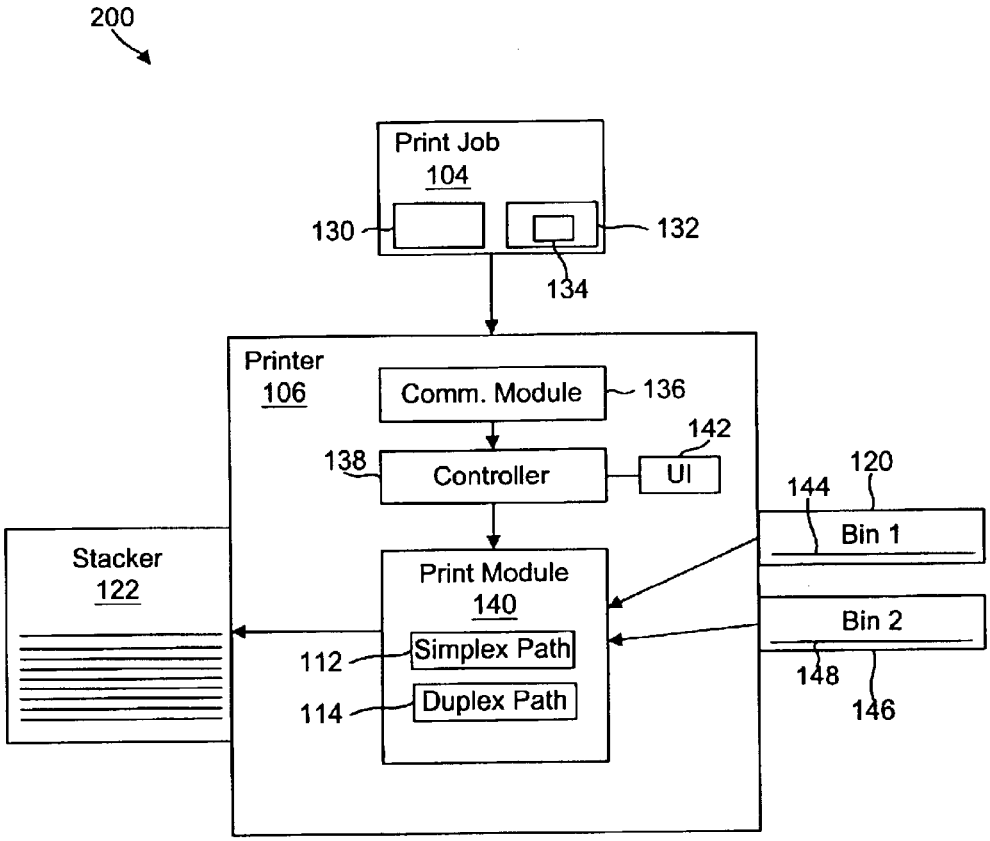
FIG. 2 is a block diagram illustrating one embodiment of a printer of the present invention.

Referring now to FIG. 2, a system 200 for implementing one embodiment of the present invention is illustrated. The system 200 includes a print job 104 from a host application 102 (See FIG. 1). The print job 104 is received by a printer 106 or other similar printing device, and is processed by the printer 106 to produce the desired printed document.

In typical embodiments the print job 104 is a collection of data 130 and control information 132. Additionally, the print job 104 may be organized into a variety of data structures including a linked list, an array, a stack, a data stream and the like. In one embodiment, the print job 104 is delivered to the printer 106 as a single collection. Alternatively, the print job 104 may be sub-divided and delivered to the printer 106 in sub-components.

The control information 132 contains instructions to the printer 106. The print job 104 identifies certain parameters for the pages of the printed document. For example, the parameters may identify the page size and whether the page is simplex or duplex. Other special printing features may be included, such as a default watermark for each page, page numbering, whether multiple copies of a document are to be printed, and if multiple copies are to be printed, whether the pages for each copy are to be collated.

In addition, the control information 132 may include a bin ID 134 that identifies the bin 120 from which paper 110 is to be drawn or fed for the pages of the document. The bin ID 134 identifies a single bin 120 for the pages of the print job 104. For example, the bin ID 134 may identify the single bin 120 as "Bin 1." This means that the print job 104 intends for all of the pages to be printed from the same bin 120. This requirement leads to the orientation sensitive duplex and simplex page printing problem discussed above. The solution to this problem is explained below.

The parameters and instructions in the control information 132 may be specified for each page or for the document as a whole. Other page printing parameters may be included in the data 130, such as formatting, style and font settings. In addition, the data 130 defines the text, graphics, and other elements to be printed on the page.

The printer 106 includes a variety of components, some of which may be implemented in hardware, software, firmware, or a combination of these. Generally, the printer 106 includes a communication module 136, a controller 138, and a print module 140. These modules 136, 138, 140 cooperate to print orientation sensitive simplex and duplex pages of a print job such that the pages are stacked in a uniform orientation.

The communication module 136 may include various known components such as a network interface, memory buffers, network communication logic, and the like. The communication module 136 receives a print job 104 from a host application 102. Preferably, the print job 104 includes a combination of simplex and duplex pages.

The communication module 136 communicates with a controller 138. The controller 138 directs a print module 140 using the data 130 and control information 132 of the print job 104. The controller 138 may be a hardware or software component or a combination thereof.

Figure 1B:
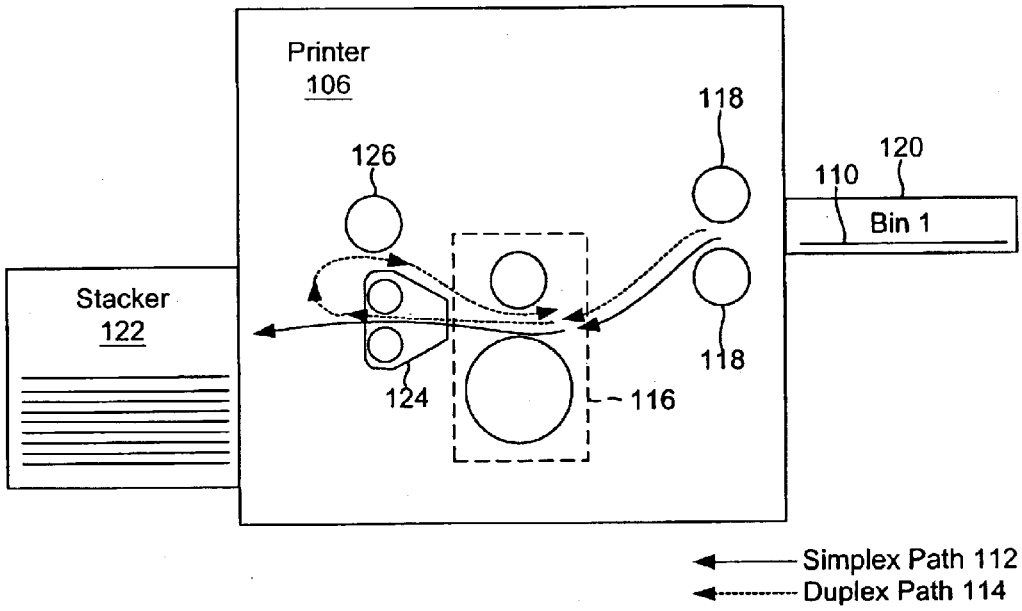
(Prior Art) FIG. 1B
FIG. 1B is a block diagram illustrating an example of a conventional printer having a simplex path and a duplex path.
Figure 1C:
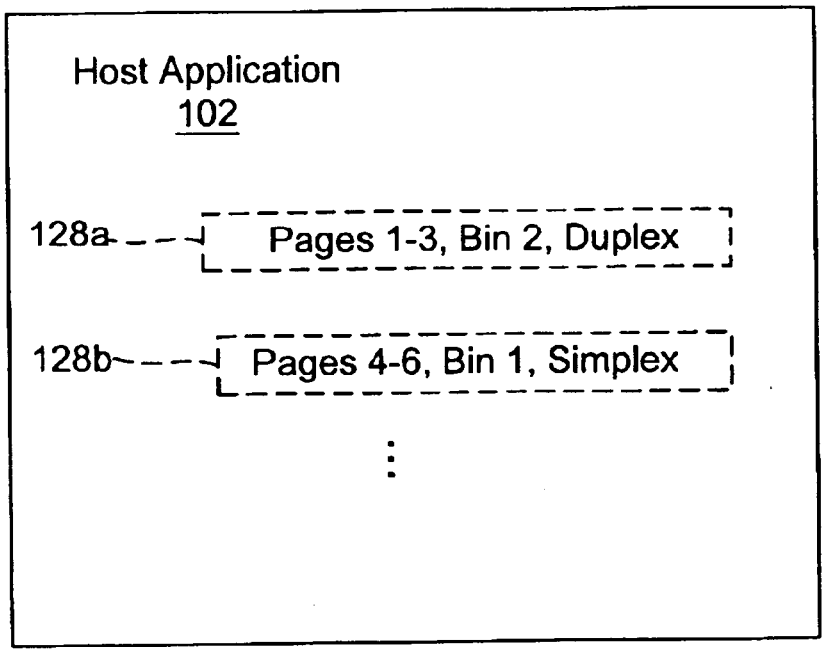
(PRIOR ART) FIG. 1C
FIG. 1C is a block diagram illustrating one conventional solution to the problem illustrated in FIG. 1A.

Referring still to FIG. 2, the controller 138 in one embodiment provides all the instructions to the print module 140. For example, the controller 138 in this embodiment directs the print module 140 regarding which bin 120 to select paper to be fed from for each page that is printed. In addition, the controller 138 may also provide the data instructions for configuring a print drum or moving a print head to deposit ink or toner on the page. The controller 138 may also direct the print module 140 to activate a flipper 124 (See FIG. 1B) to flip the printed page over and present the page for printing on the opposite side.

The print module 140 comprises various known components for moving the paper from one or more bins 120 across a print head or print drum to print the data on the page and deposit the printed page in a stacker 122. For example, the print module 140 may include various known take-up rollers 118 (See FIG. 1B), paper tracks, paper guides, paper position sensors, and the like. The print module 140 in the depicted embodiment includes a simplex path 112 for printing simplex pages and a duplex path 114 for printing duplex pages. Preferably, the simplex path 112 and duplex path 114 are arranged as explained above in relation to FIG. 1B.

In certain embodiments, the printer 106 includes a user interface 142. The user interface 142 communicates with the controller 138 to allow a user to provide instructions regarding a specific print job 104 and/or specific pages of a print job 104. The user interface 142 may comprise a graphical or text interface. Alternatively, the user interface 142 may comprise a digital readout and a keypad or a series of buttons.

Preferably, the printer 106 includes at least two bins and a stacker 122. A first bin 120 may correspond to a default bin for printing of simplex pages 144 of a document. Accordingly, the first bin 120 is also referred to herein as a simplex bin 120. A second bin 146 holds paper for printing of duplex pages 148. Similarly, the second bin 146 referred to herein as a duplex bin 146. Of course any designated bin 120 may be the duplex bin and any other designated bin 146 may be the simplex bin.

The first bin 120 and second bin 146 are in mechanical communication with the print module 140 such that the print module 140 may readily feed paper for either the first bin 120 or the second 146 as directed by the controller 138. Thus, in response to a command from the controller 138, the print module 140 feeds paper for a simplex page 144 from the simplex bin 120 and feed or thread the simplex page 144 along the simplex path 112. Similarly, the print module 140 feeds paper for a duplex page 148 from the duplex bin 146 and feeds or threads the duplex page 146 along the duplex path 114. Because the controller 138 directs the print module 140, paper passes through the print module 140 in the most efficient manner.

Preferably, the paper in the simplex bin 120 and/or the duplex bin 146 is orientation sensitive. For example, paper in the first bin 120 may be oriented for simplex pages and paper in the second bin 146 may be oriented for duplex pages. This means that paper in the first bin 120 is oriented for printing on a single side of the paper and paper in the second bin 146 is oriented for printing on both sides of the paper. In one embodiment, a user selectively orients the paper in the first and second bins In addition to being properly oriented for simplex and duplex printing, the paper in the first bin 120 and second bin 146 may be oriented such that when a combination of simplex pages and duplex pages is printed in a single print job 104, the printed pages are stacked in a uniform orientation. Thus, while the paper may be oriented for edge-sensitivity in each bin 120, 146, the paper may also be oriented for side-sensitivity. For example, pre-printed paper forms in the first bin 120 may be oriented face up, while the same pre-printed paper forms may be oriented face down in the second bin 146.

A stacker 122 is preferably provided for convenience. The stacker 122 receives printed pages from the print module 140 and stacks the pages with a uniform orientation. The configuration and complexity of the stacker 122 is not critical to the present invention. Instead of a stacker 122, printed pages may simply be deposited in a stack next to the printer 106. However, the stacker 122 may be configured to allow for more than one print job 104 to be printed and arranged in an organized manner. For example, the stacker may include a separate fin (not shown) for collecting printed pages for each print job 104.

Referring still to FIG. 2, the general operation of the system 200 will now be described. The controller 138 is configured to use the control information 132 to direct the print module 140 to feed paper for a simplex page 144 or a duplex page 148. For example, each page of the print job 104 may include an identifier that indicates whether the page is a simplex page 144 or a duplex page 148. If the page is a simplex page 144, the controller 138 commands the print module 140 to feed paper from the simplex bin 120. The paper then travels along the simplex path 112 through the print module 140 and is stacked by the stacker 122. If the next page is a duplex page 148, the controller 138 commands the print module 140 to feed paper from the duplex bin 146. The paper for the duplex page 148 then travels along the duplex path 114 and is stacked by the stacker 122 such that the final orientation of the duplex page 148 (e.g., in the stacker 122) is the same as that of a simplex page 144 in the stack.

In certain embodiments where duplex pages 148 are flipped only once, to accomplish uniform orientation of the printed simplex pages 144 and duplex pages 148, the controller 138 may direct the print module 140 to print the back side of a duplex page 148 first. Consequently, when the duplex page 148 is flipped, the front side of the duplex page 148 is printed. The duplex page 148 is then deposited on the stack without requiring any additional flipping. Alternatively, the print module 140 may be configured to automatically print the front side of a duplex page 148 first.

Figure 3:
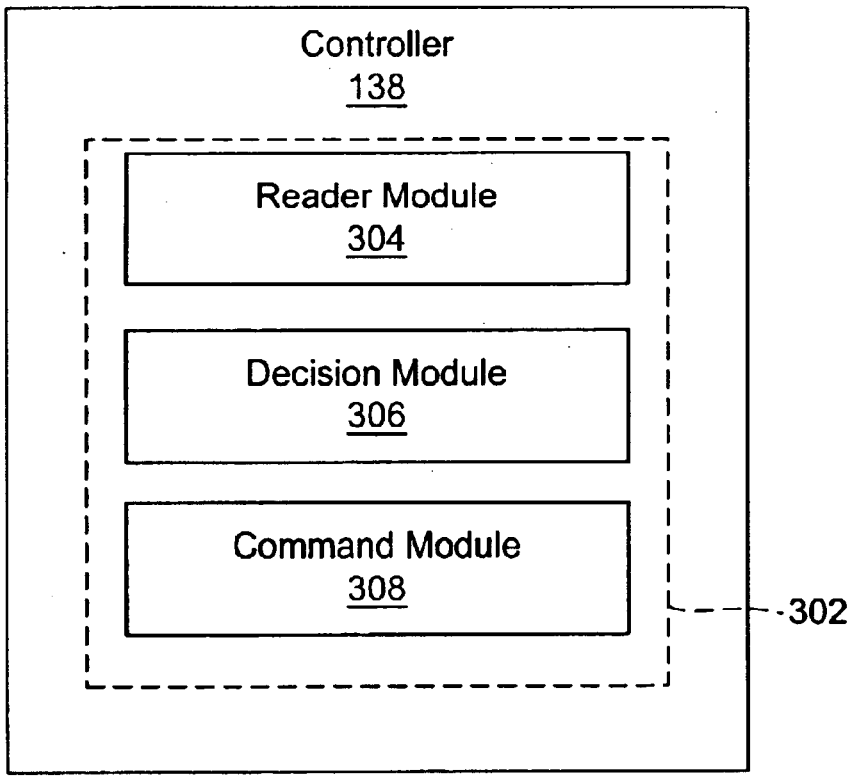
FIG. 3 is a block diagram illustrating one embodiment of a controller of the present invention.

Referring to FIG. 3, a block diagram of one embodiment of a controller 138 of FIG. 2 is illustrated. The controller 138 includes program code 302. In one embodiment, the program code 302 is configured with one or more software modules that cooperate to provide logic to designate which bin 120, 146 to direct the print module 140 to feed each sheet of paper from according to control information 132.

For example, the program code 302 may include a reader module 304, a decision module 306, and a command module 308. The reader module 304 in one embodiment is executable code programmed to read and analyze the control information 132. For example, the reader module 302 may parse the control information 132 to determine whether a page is a simplex page 144 or a duplex page 148.

The decision module 306 is in one embodiment executable code programmed to determine which bin to feed paper from for the next page of the print job. The decision module 306 preferably communicates with the reader module 304 to know whether a page is a simplex page 144 or a duplex page 148. The decision module 306 selectively designates between a first bin 120 and a second bin 146. Generally, the bin ID 134 of a print job 104 is set to indicate a single preferred bin because the bin has special paper loaded in a particular orientation such as side-sensitive paper and/or edge-sensitive paper for simplex pages.

The decision module 306 allows for the print job 104 to designate a single bin instead of a simplex bin 120 and a duplex bin 146. If a page comprises a simplex page 144, the decision module 306 designates the first bin 120, in which the paper is oriented for a simplex printing for the page. If the page comprises a duplex page 148, the decision module 306 designates that the second bin 146, containing paper oriented for duplex printing. The second bin 146 may be selected even though the print job 104 designates a preferred bin such as the first bin 120 for the whole print job 104.

The decision module 306 communicates a designated bin 120, 146 to the command module 308. The command module 308 issues the appropriate command to the print module 140 such that the print module 140 feeds the next sheet of paper from the designated bin 120, 146. For example, the command module 308 may issue electrical signals which cause certain rollers, guides, or tracks within the print module 140 to be activated such that the next page is fed from either the simplex bin 120 or the duplex bin 146. In addition, the command module 308 may issue other commands to the print module 140 as well. For example, the command module 308 may direct the print module 140 to flip the paper after printing one side such that a duplex page 148 may be produced. In one embodiment, the simplex bin 120 and duplex bin 146 are set to default bins of a printer 106. Furthermore, the control information 132 may include an indicator that a print job 104 includes simplex pages 144 and duplex pages 148. Thus, a print job 104 may be properly processed using a first bin 120 and a second bin 146 without user intervention. Alternatively, a user may use a user interface 142 to select which bin is the simplex bin 120 and which bin is the duplex bin 146. The user then manually orients the pages selectively within the simplex bin and the duplex bin. In addition, a user may use the user interface 142 to identify a pending print job 104 as orientation sensitive having both simplex pages 144 and duplex pages 148.

Figure 4:
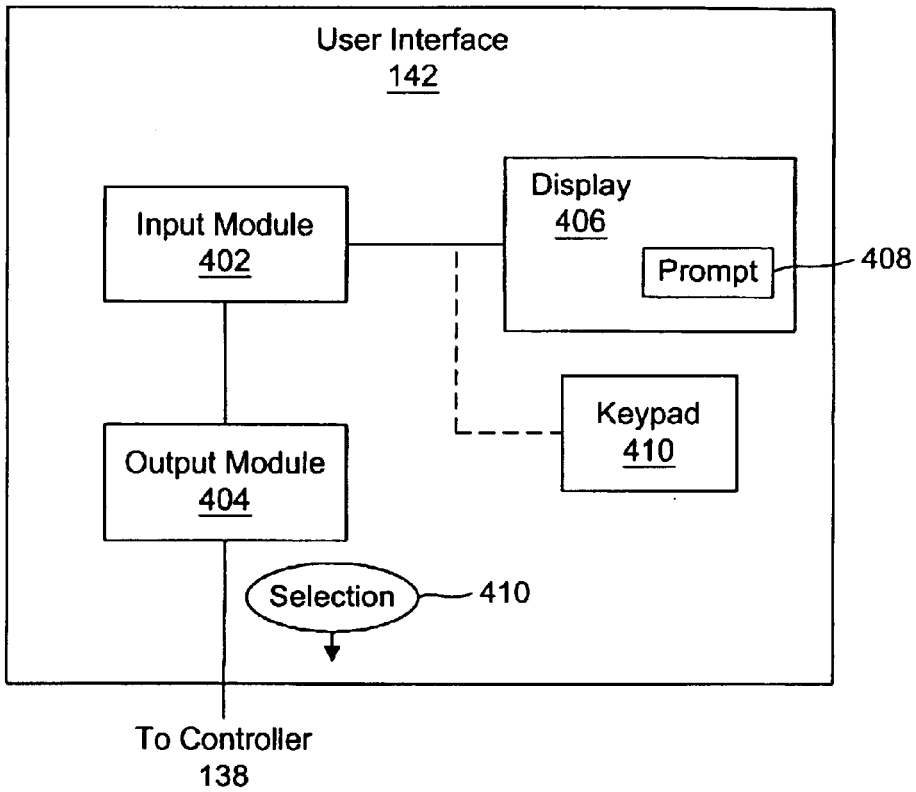
FIG. 4 is a block diagram illustrating one embodiment of a user interface according to the present invention.

Referring now to FIG. 4, one embodiment of a user interface 142 is illustrated therein. The user interface 142 includes an input module 402, an output module 404, and a display 406. The input module 402 may comprise hardware, software, or a combination thereof. The input module 402 communicates with the display 406 to prompt a user for a selection of a simplex bin 120 for simplex pages 144 and a duplex bin 146 for duplex pages 148. The input module 402 may prompt the user for each print job 104. Alternatively, the input module 402 may prompt the user for a default simplex bin 120 and a default duplex bin 146 to be used for all print jobs 104. The input module 402 may also prompt a user to identify a pending print job 104 as an orientation sensitive print job having both simplex pages 144 and duplex pages 148.

The input module 402 provides a prompt 408 to the display 406. The format of the prompt 408 depends on the capabilities of the display 406. The prompt 408 asks a question of the user and returns a response to the input module 402. The user's response is a selection 410. The selection 410 is one or more indicators of the user's selected simplex bin 120, duplex bin 146 and/or whether the print job 104 is orientation sensitive. A single selection 410 may include all these indicators or the various combinations of these. The prompt 408 may be active, meaning the prompt 408 displays and operation of the printer 106 stops until a selection 410 is provided. Alternatively, the prompt 408 may be passive, meaning that the printer 106 continues to operate using a default simplex bin 120 and duplex bin 146 until a selection 410 is provided.

The display 406 may be simple or complex. In one embodiment, the display 406 is a single-line text display 406. In another embodiment, the display 406 is a touch-sensitive color graphic image display 406. The format and capabilities of the display 406 is not critical to the present invention so long as the display 406 allows for a prompt 408 to be presented and a selection 410 to be communicated back to the input module 402 in response to the prompt 408. In certain embodiments, the user interface 142 may include a keypad 412 or other input device such as keyboard, mouse, or buttons. The keypad 412 may allow a user to provide a selection 410 in conjunction with or in place of using the display 406.

The output module 404 communicates with the input module 402. Generally, the output module 404 receives the selection 410 of the first bin 120 and second bin 146 from the input module 402. The output module 404 communicates the selection 410 to the controller 138. The output module 404 may format or re-format the selection 410 as needed to allow the controller 138 to properly use the selection 410. In addition, or alternatively, the output module 404 may communicate to the controller 138 that a pending print job 104 is orientation sensitive.

Figure 5:
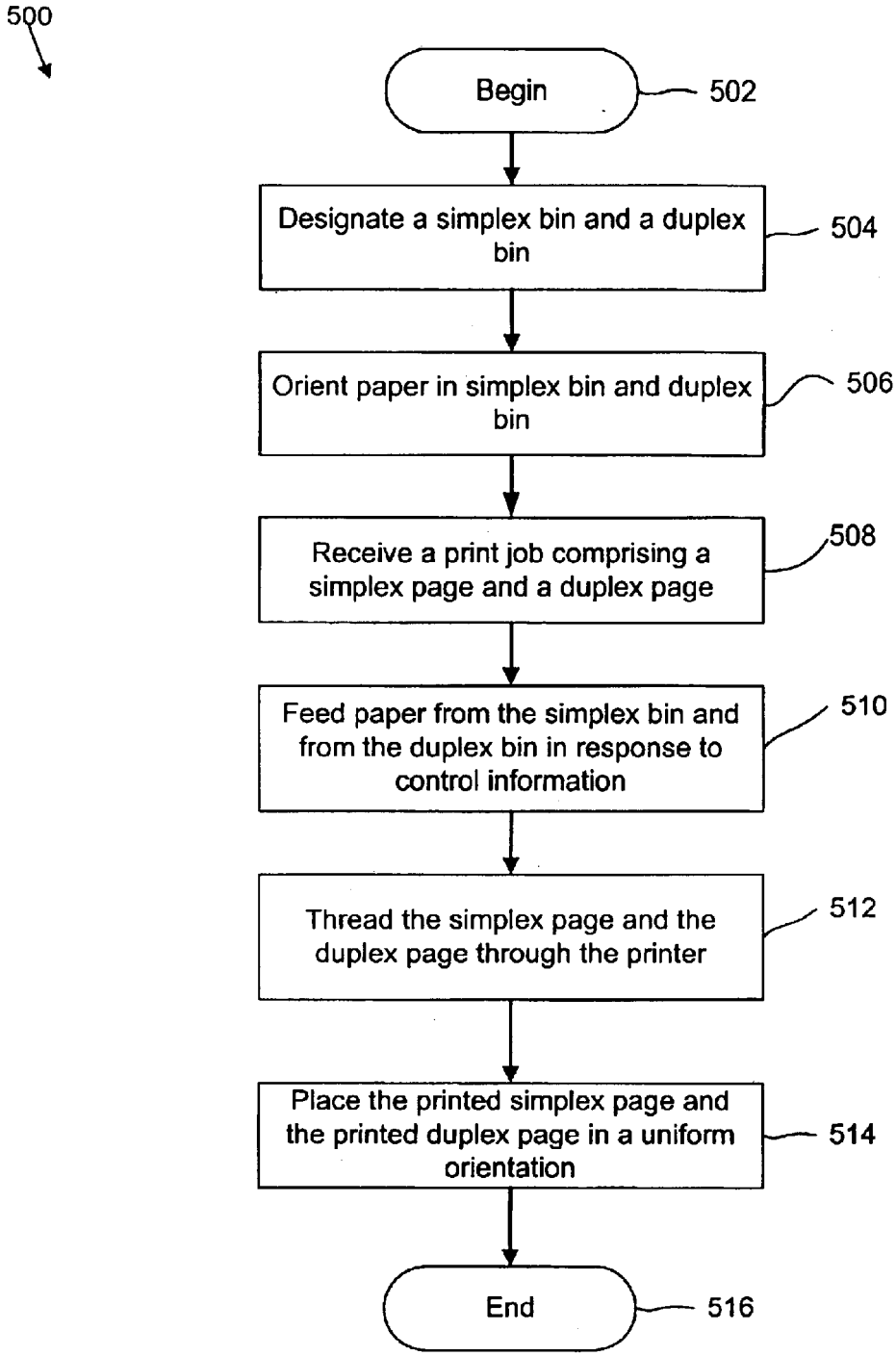
FIG. 5 is a flow chart illustrating a method of the present invention for printing an orientation sensitive print job having simplex and duplex pages.

Referring to FIG. 5, a method 500 is illustrated for printing a print job 104 for which pages are orientation sensitive. Preferably the print job 104 comprises at least one orientation sensitive simplex page 144 and at least one orientation sensitive duplex page 148. First, a simplex bin 120 and a duplex bin 146 are designated 504. As indicated above, a user may designate the simplex bin 120 and the duplex bin 146. Alternatively, a first bin 120 may be designated by default as the simplex bin 120 and a second bin 146 may be designated by default as the duplex bin 146. Before or after, the simplex bin 120 and duplex bin 146 are designated 504, a user may orient 506 the paper in the simplex bin 120 and/or the duplex bin 146. Next, a print job 104 comprising a simplex page 144 and a duplex page 148 is received 508. Paper is fed 510 from the simplex bin 120 to print the simplex page 144 and from the duplex bin 146 to print the duplex page 148 in response to control information for the print job 104. The simplex page 144 is threaded 512 through a simplex path 112 and the duplex page 148 is threaded 512 along a duplex path 114. Finally, the printed simplex page 144 and printed duplex page 148 are placed 514 in a stacker 122 such that the pages 144, 148 have a uniform orientation. Then, if all the pages have been printed, the method 500 ends 516. Alternatively, the remaining pages of the print job 104 are processed in a like manner.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for printing a print job for which pages are orientation sensitive, the apparatus comprising:

a controller in communication with a print module;

program code programmed to operate within the controller, the program code programmed to selectively designate between a first bin and a second bin for different pages of a print job based on control information associated with the print job.

2. The apparatus of claim 1, wherein the first bin comprises paper oriented for simplex pages and the second bin comprises paper oriented for duplex pages.

3. The apparatus of claim 2, wherein the program code designates the first bin in response to control information identifying a simplex page and the second bin in response to control information identifying a duplex page.

4. The apparatus of claim 1, wherein the print module comprises a simplex path and a duplex path and wherein a simplex page travels along the simplex path and a duplex page travels along the duplex path.

5. The apparatus of claim 1, further comprising a user interface which allows a user to select a first bin and a second bin.

6. The apparatus of claim 5, wherein the user interface allows the user to identify a pending print job as orientation-sensitive.

7. The apparatus of claim 1, further comprising a stacker configured to receive printed pages from the print module and stack the pages such that the pages have a uniform orientation.

8. A user interface configured for printing a print job for which pages are orientation sensitive, the user interface comprising:

a display configured to display information to a user;

an input module in communication with the display and configured to prompt a user for a selection of a first bin for simplex pages and a second bin for duplex pages of a print job; and an output module in communication with the input module, the output module communicating the selection of the first bin and the second bin to a controller in communication with a print module, the controller being configured to selectively designate between the first bin and the second bin for different pages of a print job based on control information for the print job.

9. The user interface of claim 8, wherein paper in the first bin is oriented for printing on a single side and paper in the second bin is oriented for printing on both sides.

10. The user interface of claim 8, wherein the control information identifies at least one page of the print job as a simplex page and at least one page of the print job as a duplex page.

11. The user interface of claim 8, wherein paper from the first bin follows a simplex path and paper from the second bin follows a duplex path through the print module.

12. The user interface of claim 8, further comprises a prompt that allows the user to identify a pending print job as orientation sensitive.

13. A printer capable of printing a print job for which pages are orientation sensitive, the printer comprising:

a user interface for designating a simplex bin and a duplex bin of the printer;

a communication module for receiving a print job comprising a simplex page and a duplex page;

a controller in communication with the user interface and the communication module, the controller being configured to feed paper from the simplex bin to print the simplex page and from the duplex bin to print the duplex page in response to control information for the print job.

14. The printer of claim 13, wherein paper from the simplex bin follows a simplex path and paper from the duplex bin follows a duplex path through the printer.

15. The printer of claim 13, wherein the print job designates a single bin of the printer.

16. A method for printing a print job for which pages are orientation sensitive, the method comprising:

designating a bin for simplex feeding and a bin for duplex feeding for a printer;

receiving a print job comprising a simplex page and a duplex page; and feeding paper from the simplex bin to print the simplex page and feeding paper from the duplex bin to print the duplex page in response to control information for the print job.

17. The method of claim 16, further comprising threading the simplex page along a simplex path and threading the duplex page along a duplex path through the printer.

18. The method of claim 16, further comprising placing the printed simplex page and the printed duplex page in a stacker such that the pages have a uniform orientation.

19. The method of claim 16, wherein the print job designates a single bin of the printer.

20. The method of claim 16, further comprising designating a print job as an orientation-sensitive print job.

21. The method of claim 20, further comprising a user designating the print job as orientation-sensitive through a user interface.

22. The method of claim 16, further comprising a user designating the simplex bin and the duplex bin.

23. An apparatus for printing a print job for which pages are orientation sensitive, the apparatus comprising:

means for designating a bin for simplex feeding and a bin for duplex feeding for a printer;

means for receiving a print job comprising a simplex page and a duplex page; and means for feeding paper from the simplex bin to print the simplex page and feeding paper from the duplex bin to print the duplex page in response to control information for the print job.

24. The apparatus of claim 23, further comprising means for designating the print job as orientation-sensitive.

25. The apparatus of claim 23, further comprising means for threading the simplex page along a simplex path and threading the duplex page along a duplex path through the printer.

26. The apparatus of claim 23, wherein the print job designates a single bin of the printer.

27. An article of manufacture comprising a program storage medium readable by a processor and embodying one or more instructions executable by a processor to perform a method for printing a print job for which pages are orientation sensitive, the method comprising:

designating a bin for simplex feeding and a bin for duplex feeding for a printer;

receiving a print job comprising a simplex page and a duplex page; and feeding paper from the simplex bin to print the simplex page and feeding paper from the duplex bin to print the duplex page in response to control information for the print job.

28. The article of manufacture of claim 27, wherein the method further comprises designating the print job as orientation-sensitive.

29. The article of manufacture of claim 27, wherein the method further comprises threading the simplex page along a simplex path and threading the duplex page along a duplex path through the printer.

30. The article of manufacture claim 27, wherein the print job designates a single bin of the printer.

* * * * *